US006293314B1

(12) United States Patent
Dewispelaere

(10) Patent No.: US 6,293,314 B1
(45) Date of Patent: Sep. 25, 2001

(54) PILE YARN SELECTION SYSTEM FOR GRIPPER AXMINSTER WEAVING MACHINES

(75) Inventor: André Dewispelaere, Marke/Kortrijk (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 09/598,654

(22) Filed: Jun. 22, 2000

(30) Foreign Application Priority Data

Jun. 25, 1999 (BE) ..... 09900441

(51) Int. Cl.[7] ..... D03D 39/08; D03D 51/18; D03D 39/02

(52) U.S. Cl. ..... 139/2; 139/7 A; 139/21; 139/455

(58) Field of Search ..... 139/2, 7 A, 21, 139/455

(56) References Cited

U.S. PATENT DOCUMENTS 3,963,058 * 6/1976 Dewhirst ..... 139/2
5,743,306 * 4/1998 Stewart et al. ..... 139/7 A
5,806,568 * 9/1998 Dewipelaere et al. ..... 139/2

FOREIGN PATENT DOCUMENTS 2286601 8/1995 (GB) .
2189515 10/1997 (GB) .
2313132 11/1997 (GB) .

* cited by examiner

*Primary Examiner*—Andy Falik
(74) *Attorney, Agent, or Firm*—James Creighton Wray; Meera P. Narasimhan

(57) ABSTRACT

A selection system for pile yarns in a gripper Axminster weaving machine has a gripper associated with an elongated pile yarn carrier, and provided to position a number of yarn ends at mutual distance in the length direction of that carrier. Each pile yarn carrier is axially movable in its length direction to present a selected yarn to an associated gripper. A movable selection beam effects the axial movement of the pile yarn carriers, coordinated with the movement of the grippers, by protrusions and notches working together on the pile yarn carriers and on the selection beam. The engagement into each other of the aforesaid protrusions and notches can be selectively controlled in function of the yarns to be selected, in which the pile yarn carriers are predominantly horizontally disposed. The selection beam positively drives the pile yarn carriers in horizontal direction both in forward and in return movement. The pile yarn carriers can be brought and/or held in positions of rest by a vertical movement of the selection beam.

17 Claims, 1 Drawing Sheet

PILE YARN SELECTION SYSTEM FOR GRIPPER AXMINSTER WEAVING MACHINES

Figure 1:
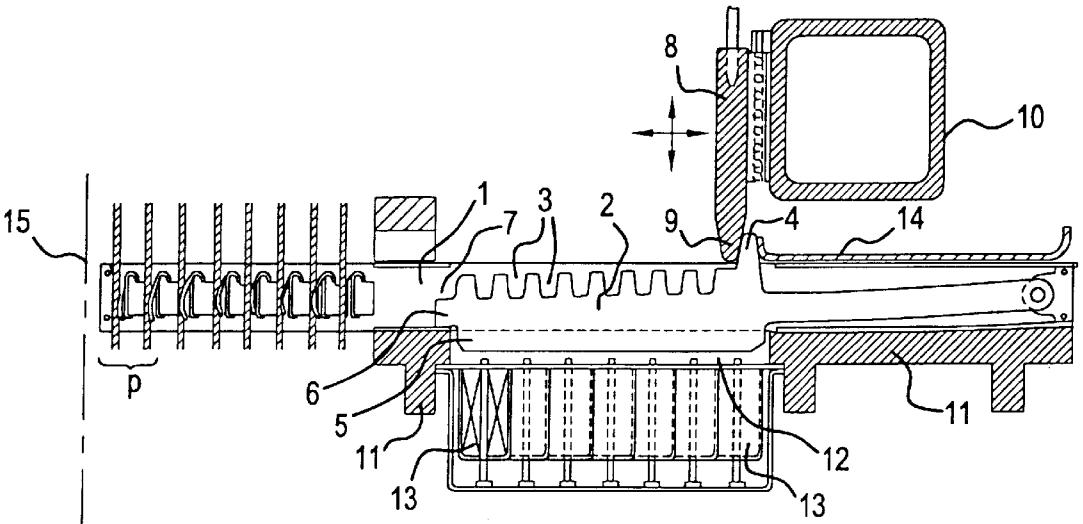

The invention relates to a method and a device for selecting pile yarns in gripper Axminster weaving machines, more specifically in carpet weaving machines of the gripper Axminster type. With such weaving machines the pile yarns of different colors are placed next to each other in a line in pile yarn cariers, which are moved in a lengthways direction under control of an electronic jacquard device through movement according to the pattern, in order to bring the selected color opposite the gripper jaws.

In such carpet weaving machines the pile yarns are held in pile yarn cariers which protrude in a horizontally, obliquely or vertically disposed direction. The pile yarn ends protrude out of the pile yarn cariers sufficiently on one side in order to be taken along by gripper jaws. The gripper jaws are rotatably disposed in order to grip the protruding yarn ends in an upwardly rotating movement and in order to bring these downward, so that they can be woven into the backing fabric of the carpet.

From the British patent publication GB 2 231 590 such a device is known for selecting pile yarns in gripper Axminster weaving machines. In this device a hinged extension piece of the pile yarn cariers is placed with a protrusion in a certain notch on the lifting beam through the action of an electro-plunger magnet.

A first disadvantage of this device is, that this can only work when the pile yarn cariers are disposed vertically or obliquely up to an angle of max. 45° to the vertical. Gripper Axminster weaving machines with horizontally disposed pile yarn cariers can weave considerably faster because of the fact that the angle of rotation of the pile grippers is considerably smaller.

A second disadvantage is that the pile yarn cariers must be provided of a return device with lingots or return springs in order to hold the protrusion of the rotatable part of the pile yarn cariers in the notch of the lifting beam. This is particularly necessary in order to bring the selected pile yarn into a line for the gripper jaws. These lingots or return springs considerably load the drive of the lifting beam. The jacquard drive therefore limits the weaving speed of a gripper Axminster weaving machine.

At higher weaving speeds the inertia of the pile yarn cariers poses an additional problem. At the end of the travel of the selection movement the selection is completed, but the pile yarn cariers do not immediately come to a standstill through effect of the force of inertia. Through the clearance which is present between the protrusion and the notch on the lifting beam, the pile yarn cariers with the selected pile yarns do not come to lie properly in a line. This causes wear and tear on the protrusion and after a time the protrusion can jump out of the selected notch through which a fault occurs in the selection.

Patent publication GB 2 286 601 shows a pile yarn selection device with horizontally disposed pile yarn cariers. This arrangement is favorable for reaching a higher weaving speed. In practice that higher weaving speed is not sufficiently reached. The forces of inertia on the pile yarn carier at the end of the selection movement are the cause of selection faults: the pile yarn cariers slide through under the selection leaf spring as with a ratchet. The leaf spring is not capable of positioning the pile yarn carier through which faults occur in the selection and the selected pile yarns are not presented in a line. This problem can only be remedied to a limited degree by applying a greater spring pretensioning in the spring return device. The drive must then indeed provide a much greater drawing power to the springs and the selection leaf spring has limited load bearing capacity due to buckling.

This device also limits the weaving speed of a gripper Axminster weaving machine.

SUMMARY

The purpose of the invention is to develop a jacquard device or pile yarn positioning system for gripper Axminster weaving machines which is suitable for high weaving speed and whereby no return spring device is necessary.

By pile yarn selection system in this context is understood both a method and a device for selecting pile yarn.

In order to achieve the above mentioned purpose the invention provides a pile yarn selection system for gripper Axminster weaving machines, whereby each gripper is associated with an elongated pile yarn carrier, provided in order to position a number of yarn ends at mutual distance according to the length of that carrier, whereby each pile yarn carrier is axially movable according to its length in order to present a selected yarn to an associated gripper, and whereby a movable selection beam effects the axial movement of the pile yarn cariers, coordinated with the movement of the grippers, by means of protrusions and notches working together on the pile yarn carriers and on the selection beam, while the engagement into each other of the aforesaid protrusions and notches can be selectively controlled in function of the yarn to be selected, in which:

- the pile yarn carriers are predominantly horizontally disposed,
- the selection beam positively drives the pile yarn carriers in horizontal direction both in forward and in return movement,
- and the pile yarn carriers comprise a position of rest into which they can be brought and/or held by a vertical movement of the selection beam.

According to an additional characteristic of the invention the pile yarn carriers are, preferably, provided next to one another on a supporting table and each provided with a hinged arm each of which can be brought by means of a selectively activatable push mechanism into a position, protruding in one direction, whereby protrusions and notches on the arms and the selection beam can engage in each other, and in the supporting table one or more recesses are provided into which a part of the aforesaid hinged arm protruding in opposite direction can fit in position of rest.

According to the invention each arm can furthermore very suitably be provided with a tooth with which all pile yarn carriers are taken back to the position of rest by the selection beam, on its return movement.

According to another more specific preferred characteristic of the invention the aforesaid means which can be selectively activated in order to make the aforesaid protrusions and notches engage in each other consist namely of electro-plunger magnets.

Upon reaching their position of rest the hinged arms of the pile yarn carriers are preferably brought and/or held in the recess in the supporting table by vertical movement of the selection beam, and therefore by a positive action of that selection beam.

According to the preferred embodiment of the invention the pile yarn carriers of the selection system can each be provided with a hinged rack, which is equipped with a number of tooth spaces corresponding to the number of yarn positions in each reed opening of the selection system, intended to work together selectively with a protruding tooth on the selection beam, with its forward movement, whereby the hinged rack is furthermore provided with one more protruding tooth with which the pile yarn carriers with the return movement of the selection beam are brought back to the position of rest.

More specifically the horizontal pile yarn carriers, disposed next to one another on a supporting table, can each be provided with an in vertical direction hinged arm which is provided with tooth spaces on its upper side and which can be brought by means of a selectively activatable electro-plunger magnet or electro-pneumatic plunger into a position protruding upward whereby a tooth protruding downward on the selection beam can selectively engage in a tooth space on the top of the hinged arm, while each hinged arm is also provided with a tooth protruding upward with which all pile yarn holders are taken back by the selection beam, with its return movement to the position of rest, and one or more recesses can be provided in the supporting table into which a part of the hinged arms protruding downward can fit in position of rest.

According to this preferred form of the invention the pile yarn carriers are thus provided with a hinged rack. This rack is provided with a number of tooth spaces. The number of tooth spaces n is equal to the number of colors that it is desired to weave per reed space. The pitch of the tooth spaces is equal to the distance between two pile yarns in one and the same pile yarn carrier. The rack is provided with an additional tooth which extends above the tip surface of the tooth spaces. The rack is hingingly attached to the pile yarn carrier and can be moved into two extreme positions. In a first position the rack is pivoted downward and the back of the rack protrudes at the bottom out of the pile yarn carrier while the tip surfaces of the teeth are just below the top face of the pile yarn carrier and the one additional tooth still extends above this top face. In the second position the rack is pivoted upward, whereby the bottom of the rack back lies in line with the bottom face of the pile yarn carrier, while the teeth extend completely above the top face of the pile yarn carriers.

The pile yarn carriers are placed next to one another on a supporting table. In this supporting table a recess is provided which is slightly wider than the length of the bottom part of the rack back. The bottom part of the rack must be able to fall or be pushed into this recess. In this recess electro-plunger magnets are provided or electro-pneumatic plungers, one plunger per pile yarn carrier. These plunger magnets serve to push the rack from the bottom into the top position.

Above the pile yarn carriers a knife beam is disposed. This knife has a pointed tooth on the bottom side which fits into each of the tooth spaces of the rack. This tooth is vertically and horizontally movable. The horizontal movement serves for the return and selection movement, the vertical upward movement serves for lifting the knife out of the tooth spaces, the downward movement serves for pushing the rack backs into the selection recess, in order to set the selection play, and in order at the end of the selection movement to press the pile yarn carriers onto the table, so that there is no longer any play between tooth spaces and the knife and through which the vibrations in the pile loaders are damped. Because of this all selected pile yarns come to lie properly in a line.

The end of the return movement of the pile yarn carriers is limited by the light pressing of the additional protruding tooth of the rack against a stop plate so that the rack back can fall with still some clearance into the recess of the table and can there be pushed into a non-selected position. A rack not lifted by a plunger remains pressed against the recess edge so that a non-selected pile yarn carrier is not taken along by a selected neighbor through mutual friction and adhesive forces.

The characteristics and distinctive features of the invention, and the operation thereof are further explained hereafter with reference to the attached drawings which show a preferred embodiment of the invention. It should be noted that the specific aspects of this embodiment are only described as preferred examples of what is intended in the scope of the above general specification of the invention, and may in no way be interpreted as a restriction on the scope of the invention as such and as expressed in the following claims.

In these drawings FIG. 1 is a schematic representation of the device whereby all pile yarn carriers are in a non-selected position after the return movement. The knife is in its extreme right-hand position and has pushed all reeds into the recess of the table.

Figure 2:
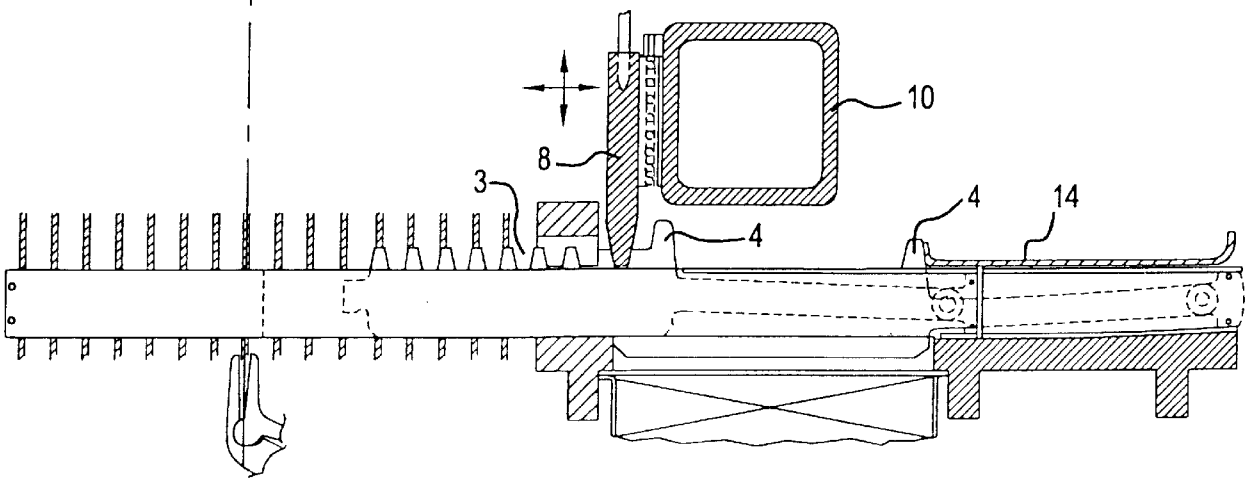

FIG. 2 is a representation whereby the knife is in its extreme left-hand position at the end of the selection movement, the knife presses the pile yarn carriers onto the table.

DETAILED DESCRIPTION

With a rapier Axminster weaving machine with horizontally disposed pile yarn carriers the pile yarns come from packages in the creel over a guiding device to a distribution grid which is disposed above the pile yarn carriers. Out of this distribution grid the pile yarns are guided vertically downward in order to finish up in the pile yarn carriers. For each reed space such a pile yarn carrier is provided in order to present the pile yarn to a pile yarn gripper working together with it. The pile yarn gripper draws the necessary yarn length from the yarn supply, a cutting device cuts off the drawn yarn length and the gripper rotate toward the fell of the fabric in order to have the drawn pile yarn woven in there. It is the object that the pile yarn carriers select the color that must be woven according to the weaving pattern in order to form a pattern in the fabric.

The pile yarns are brought into a pile yarn carrier in a known manner. Hence namely as drawn in FIG. 1 for 8 colors by way of example. Generally n colors are provided. The pile yarns protrude slightly from the carrier so that these can be gripped by the mutual pile yarn gripper jaws. The selected yarns are brought into one line for the pile yarn gripper jaws by shifting the pile yarn carriers. The pile yarn carriers extend in warp direction. The pile yarn gripper jaws grip the pile yarns which have been brought to the selection line. The grippers draw a specific pile length out of the pile yarn carriers and a cutting device cuts off the drawn pile yarns from the supply. The grippers rotate toward the fell of the fabric, through which the pile yarn ends are interlaced in the fabric by the weft yarn.

A pile yarn carrier (1) is formed by two elongated walls. In FIG. 1 the front wall has not been drawn. Between these walls on the one side 1, 2, . . . n pile yarns are held at mutual distance p in a known yarn clamping device. Between the walls there is a rack(2) with a shank, which is pivotably attached to the other extremity of the pile yarn carrier. The rack is provided on the top with n tooth spaces (3) with a pitch equal to p. On the shank side an additional protruding tooth (4) is provided which extends above the tip surface of the n spaces. At the bottom the rack is provided with a back (5). The rack can be moved into two extreme positions in the pile yarn carrier: with the back out of the pile yarn carrier pivoted downward or with the tooth spaces out of the pile yarn carrier pivoted upward. On the left-hand side of the rack abut surfaces (6, 7) are provided in order to limit the pivotal movement by stopping against a folded part of the walls.

Above the pile yarn carriers a movable knife (8) is provided. This knife has a pointed tooth (9) toward the bottom which can engage in each of the n tooth spaces (3). The knife (8) can move in vertical and horizontal directions. Knife (8) is connected to a type of beam(10) which extends over the entire width of the weaving machine and is movably connected over guides to the main frame of the weaving machine. The beam can move horizontally in warp direction and vertically up and down. The beam is driven according to two mutually perpendicular axes with a two-axis drive. The drives and the guides are not represented in the drawing. These are known from machine tools. The drive can also be implemented with a cams and rods mechanism. A drive with servomotor over guides with a trajectory control under numerical control such as this is known from machine tools, is preferred.

The pile yarn carriers are supported by a table (11). In the supporting table a recess (12) is provided. The rack backs (5) fit into the recess (12) with a certain clearance. Below the recess (12) electro-plunger magnets (13) are provided, which are placed in modules. A pile yarn carrier (1) is operated by only one electromagnet (13). The pile yarn carriers have a partition of e.g. 3.65 mm with a weaving reed pitch of 276/m. The electromagnets have a larger diameter and for that reason these are disposed in a staggered manner. As alternative electro-pneumatic plungers can also be used.

At the start of the return movement, i.e. the horizontal movement from left to right of the knife (8) with beam (10) (FIG. 2), the knife (8) is lifted vertically out of the tooth spaces (3) to above the tip surface of the rack which are lifted upward by a previously made selection and therefore protrude out of the pile yarn carriers. With the return movement to the right the knife tooth (9) will take along each previously selected pile yarn carrier with the protruding tooth (4) until this tooth is brought against the stop plate (14), see FIG. 1. The knife (8) now moves horizontally e.g. 1 mm back to the left in order to release the tooth (4). Subsequently the knife (8) moves vertically downward over a distance equal to the space depth in order to push the rack back (5) into the recess (12) of the table through which every pile yarn carrier comes into the non-selected position, see FIG. 1. In this position the pile yarn carriers lie unpretensioned: the clearance provided between the rack-back length and width of recess (12) enables a certain movement in warp direction. This facilitates the control of the racks by the plunger magnets.

The knife (8) is now lifted by e.g. 1 mm in vertical direction in order to set a certain clearance between knife tooth (9) and tooth space (3) when the rack is completely pivoted upwards. Knife (8) and beam (10) now perform a horizontal movement to the left, the selection movement, whereby a constant height of the knife (8) is maintained.

The knife (8) first reaches the tooth space which corresponds to color no. 8 for example. See FIG. 1. When this color no. 8 has to be selected, then the electro-plunger magnet of the corresponding pile yarn carrier will be energized by the control. The plunger strikes against the back of the rack through which this is pushed upward and the first tooth space will engage on the moving knife tooth (9). The rack back (5) is lifted above the level of the table (11) and can therefore be taken along by the knife (8) in a sliding movement. As soon as the rack back (5) is above the table (11) the energizing of electromagnet (13) can be stopped. The rack remains form closed connected with its space (3) on the knife tooth (9). If e.g. color no. 5 has to be selected, then the control waits until the knife (8) is above the corresponding tooth space no. 5 in order to energize the electro-plunger magnet for that rack space. Hence each color can be selected phased according to the momentary position of the knife in the course of the selection movement. During the selection movement there is a certain clearance present between tooth space (3) and the knife tooth (9), so that the pile yarn carriers are not pressed onto the supporting table (11) during the sliding movement, through which the friction on the supporting table is minimal.

The selection movement ends when the knife (8) has traveled a horizontal path which is equal to the horizontal distance of color no. n to the gripper line (15). In that position the horizontal movement of the knife (8) is stopped. See FIG. 2. The knife is now moved slightly downward in order to remove the clearance between the knife tooth (9) and the tooth space (3). The pile yarn carriers are because of this pressed well onto the table: the vibrations of the pile yarn loaders are damped and the selected pile yarns are precisely secured on the selection line (15). FIG. 2. The pile gripper jaws pick the presented yarns which are cut off by the cutting device. This is not represented in the drawing.

Subsequently the knife (8) is moved vertically upward over a distance equal to the space depth. The return movement is started again and the cycle can restart.

For the operation there are no return springs required: the selection movement and return movement is positively performed by the knife which acts on the tooth spaces and protruding teeth. The racks are positively pushed and held in non-selected position. Selected carriers are coupled to the moving knife by a toothing. The moving knife exerts no pressure on the pile yarn carriers during the sliding. This device is suitable for a high weaving speed.

The knife (8) can also be implemented as a spring comb, whose leaf spring extremities are folded back into a pointed form (9). When a pile yarn carrier jams or becomes overloaded, the corresponding leaf spring can jump out of the tooth space, through which damage will be prevented.

It is of course also possible to reverse the device: placing the knife at the bottom and the electromagnets on top. The racks must then be held in the top position with a spring in order to hold the rack backs in the recess between the upper plates.

It is also possible for example to provide the knife with tooth spaces (and with a protruding tooth for the return movement), while one tooth is provided on each hinged arm of the pile yarn carriers.

What is claimed is:

1. Method for selecting pile yarns in rapier Axminster weaving machines comprising providing rapiers, associating each rapier with elongated pile yarn holders for positioning a number of thread ends at mutual distance according to a length of each pile yarn holder, moving each pile yarn holder axially according to its length for presenting a selected thread to an associated rapier, effecting axial movement of the pile yarn holders by a movable selection beam, coordinating the movement of the pile yarn holders with a movement of the rapiers by means of protrusions and notches working together on the pile yarn holders and on the selection beam, selectively activating the engagement into each other of the protrusions and notches for selecting threads, disposing the pile yarn holders generally horizontally, positively driving the pile yarn holders in a horizontal direction forwards and backwards with the selection beam, bringing a part of the pile yarn holders into one or more recesses on a supporting table, and/or holding the pile yarn holders at rest by vertically moving the selection beam in a position of rest.

2. The method of claim 1, further comprising providing the pile yarn holders adjacent to one another on the supporting table, providing each pile yarn holder with a hinged arm, bringing each hinged arm into a position by a selectively activatable pressing mechanism protruding in one direction, providing the protrusions and notches on the arms and on the selection beam for mutual engagement with each other.

3. The method of claim 2, further comprising providing each arm with a tooth for returning the pile yarn holders to the position of rest by the selection beam in a return movement.

4. The method of claim 2, further comprising vertically moving the support beam for bringing the hinged arm of the pile yarn holders in the position of rest in a recess in the supporting table.

5. The method of claim 2, further comprising providing the horizontal pile yarn holders disposed next to one another on the supporting table with the vertical hinged arm having tooth spaces on an upper side, positioning the hinged arm as an upward protrusion by a selectively activatable electro-plunger magnet, providing the protrusions as toothed protrusions on the selection beam for selectively engaging in the tooth space on the hinged arm, providing each hinged arm with a tooth protruding upward for returning all the pile yarn holders with the selection beam on a return movement to the position of rest, providing one or more recesses on the supporting table for interfitting a part of the hinged arms protruding downward in the position of rest.

6. The method of claim 2, further comprising effecting an axial movement of the pile yarn holders with the selection beam by elastic means thereby disconnecting during overloading or jamming of the yarn holders.

7. The method of claim 1, wherein the selectively activating for engaging the protrusions and notches comprises controlling with electro-plunger magnets.

8. The method of claim 1, further comprising providing a hinged rack on each pile yarn holder, providing the hinged rack with plural tooth spaces corresponding to a number of yarn end positions in a reed opening, wherein the tooth spaces work together selectively with a protruding tooth on the selection beam when moving forwards, and providing the hinged rack with a protruding tooth for bringing back the pile yarn holders to the position of rest with a return movement of the selection beam.

9. A device for selecting pile yarns in rapier Axminster weaving machines comprising rapiers, plural elongated pile yarn holders axially movable according to their length for positioning plural thread ends at mutual distance according to a length of each holder, the rapiers being associated with the pile yarn holders for taking up a selected thread end, a movable selection beam, protrusions and notches on the pile yarn holders and on the selection beam for mutually engaging each other and for moving the pile yarn holders, a mechanism for selectively activating engagement of the protrusions and notches into each other corresponding to the threads to be selected, the pile yarn holders being generally horizontally disposed on the selection beam, a driver for driving the pile yarn holders horizontally in forward and return movements, the selection beam being adapted to be movable in both horizontal and in vertical directions, a supporting table having one or more recesses are for receiving the protrusions of the pile yarn holders and for moving the pile yarn holders vertically and/or holding the pile yarn holders in a position of rest.

10. The device of claim 9, wherein the pile yarn holders are adjacent to one another on the supporting table, further comprising a hinged arm on each pile yarn holder, protrusions and notches on the hinged arms complementary to the protrusions and notches on the selection beam for mutual engagement, and selectively activatable pressing mechanisms for bringing the pile yarn holders into position for engaging respective protrusions and notches.

11. The device of claim 10, further comprising a tooth on each arm for working together with the selection beam for the horizontal return of the pile yarn holders to the position of rest.

12. The device of claim 9, wherein each horizontal pile yarn holder is disposed next to one another on the supporting table and comprises an upwards and downwards pivotable arm having tooth spaces on an upper side, the pivotable arm being positionable by the mechanism for selectively activating into an upward protruding position for engaging a tooth protruding downwards on the selection beam with a tooth space on top of the pivotable arm, each pivotable arm having a tooth protruding upward for returning all pile yarn carriers with the selection beam on a return movement to the position of rest, and the one or more recesses on the supporting table being adapted for interfitting a part of the pivotable arms protruding downward in the position of rest.

13. The device of claim 9, wherein the mechanism for selectively activating is electro-plunger magnets for engaging respective protrusions and notches.

14. The device of claim 9, wherein the mechanism for selectively activating is electro-pneumatic-plungers for engaging respective protrusions and notches.

15. The device of claim 9, wherein each pile yarn carrier has a hinged rack with plural tooth spaces corresponding to a number of yarn end positions in a reed opening of a selection system, and a protruding tooth on the selection beam complementary to the tooth spaces for engaging in a forward movement, the hinged rack further comprising a protruding rack tooth for engaging the pile yarn carriers on a return movement of the selection beam for returning to the position of rest.

16. The device of claim 9, further comprising elastic means on the pile yarn carriers for elastically withdrawing in case of overloading or jamming of the device.

17. The device of claim 16, wherein the selection beam has a spring comb with folded-back pointed leaf spring extremities, each extremity adapted for elastically engaging tooth spaces on a respective pile yarn holder and for moving out of engagement in case of overloading or jamming of the device.

* * * * *